US006196334B1

(12) United States Patent
Stockton

(10) Patent No.: US 6,196,334 B1
(45) Date of Patent: Mar. 6, 2001

(54) EXCAVATING TOOL

(75) Inventor: Jerry L. Stockton, Vestaburg, MI (US)

(73) Assignee: J & L Land, L.L.C., Vestaburg, MI (US)

( * ) Notice: Subject to any disclaimer, the term of this patent is extended or adjusted under 35 U.S.C. 154(b) by 0 days.

(21) Appl. No.: 09/325,048

(22) Filed: Jun. 3, 1999

(51) Int. Cl.[7] ..... A01B 1/02

(52) U.S. Cl. ..... 175/20; 172/25; 172/377; 294/55

(58) Field of Search ..... 37/379; 172/25, 172/41, 371, 377; 52/741.11, 741.15; 175/20; 294/55, 50.6, 49, 50.7

(56) References Cited

U.S. PATENT DOCUMENTS

| | | | | |
|---|---|---|---|---|
| 307,324 | | 10/1884 | Pattison . | |
| 528,607 | * | 11/1894 | Peat | 172/377 |
| 623,767 | | 4/1899 | Carroll . | |
| 861,107 | * | 7/1907 | Goggin | 172/377 |
| 1,109,469 | | 9/1914 | Sandberg . | |
| 1,229,955 | | 6/1917 | Heller . | |
| 2,161,040 | | 6/1939 | Harmon, Jr. . | |
| 2,283,669 | | 5/1942 | Edgren . | |
| 2,405,811 | | 8/1946 | Beyer . | |
| 3,106,419 | | 10/1963 | Estwing . | |
| 3,847,227 | * | 11/1974 | Myers | 294/50.7 |
| 4,618,003 | * | 10/1986 | Hostetter | 172/25 |
| 4,659,127 | * | 4/1987 | Hancovsky | 294/50.7 |
| 4,901,800 | * | 2/1990 | Wilson | 172/25 |
| 5,706,546 | | 1/1998 | Utley . | |
| 6,050,344 | * | 4/2000 | Larson et al. | 172/25 |

* cited by examiner

*Primary Examiner*—William Neuder
(74) *Attorney, Agent, or Firm*—Reising, Ethington, Barnes, Kisselle, Learman & McCulloch, P.C.

(57) ABSTRACT

A tool for excavating material from the bottom of a hole formed in the earth has a rotatable crankshaft adjacent one end of which is a hollow housing open at one end and coupled to the crankshaft for rotation therewith about a vertical axis and for rocking movements relative to the crank about a horizontal axis. The housing has a bottom wall and upstanding side walls for supporting loose material excavated from the hole in response to rotation of the crankshaft and the housing within the hole. The pivotal coupling of the housing to the crankshaft is such that gravity biases the housing to a position in which the contents of the housing are restrained from passing through the open end as the crankshaft and the housing are withdrawn from the hole.

18 Claims, 2 Drawing Sheets

4
2
3
3
3
8
13
17
5
11
7
6

1
7
8
13
16
10
11
17
18
12
9
5
6

EXCAVATING TOOL

This invention relates to a hand operable excavating tool and more particularly to a tool which is especially adapted for use in removing material from the bottom of a substantially cylindrical hole formed in the earth.

BACKGROUND OF THE INVENTION

It is common practice for a contractor to bore a plurality of vertically extending, cylindrical holes in the earth for various purposes such as the accommodation of concrete piers, pylons, or the like which are to be used as foundations or supports for buildings of various kinds. It is fairly common for construction codes to require the inspection and approval of the location and depth of the holes before they can be filled with the foundation material. On many occasions a contractor will bore the holes as required but the inspection and approval thereof may be delayed for a substantial period of time. In this event it is not uncommon for the walls of some of the holes to crumble or otherwise deteriorate or for sand or other debris to be blown into the holes. When this occurs it is necessary to remove the sand or other debris so that the depth and condition of the holes will conform to specifications and so that the bottom of the holes will be flat or horizontal.

In many instances the nature of the ground or the closeness of the holes to one another prevents the utilization of a tractor or other power apparatus from being used in removing material from the bottom of the holes, so the operation must be performed manually. Hand operated apparatus proposed heretofore for clearing debris from holes has been less than satisfactory.

SUMMARY OF THE INVENTION

Apparatus especially adapted for use in excavating or clearing by hand loose earth and other debris from a vertically extending, cylindrical hole comprises a crank having an elongate shaft of such length as to extend from the bottom of the hole upwardly and beyond the upper end of such hole. A hollow housing is pivoted to the shaft adjacent its lower end for rocking movements about a substantially horizontal axis. The housing is of quadrant shape and extends laterally of the crankshaft a distance corresponding substantially to the radius of the hole. The housing has an open side which enables loose earth and other debris at the bottom of a hole to be accommodated in the housing in response to rotation of the crank following lowering of the crankshaft and housing into the hole. The pivotal mounting of the housing on the crankshaft enables the housing to tilt as the crank and housing are withdrawn from the hole, and the direction in which the housing tilts is such as to ensure that whatever loose material is within the housing is retained therein by gravity.

In one embodiment the housing has a side wall provided with an adjustable scoop that is movable radially inward and outward so as to enable the housing to be used with holes of different diameters. The scoop has a flange at its lower end which provides support for debris when the scoop is in its radially extended position.

THE DRAWINGS

Apparatus constructed in accordance with the presently preferred embodiments of the invention are illustrated in the accompanying drawings wherein.

DETAILED DESCRIPTION

Figures 1, 2:
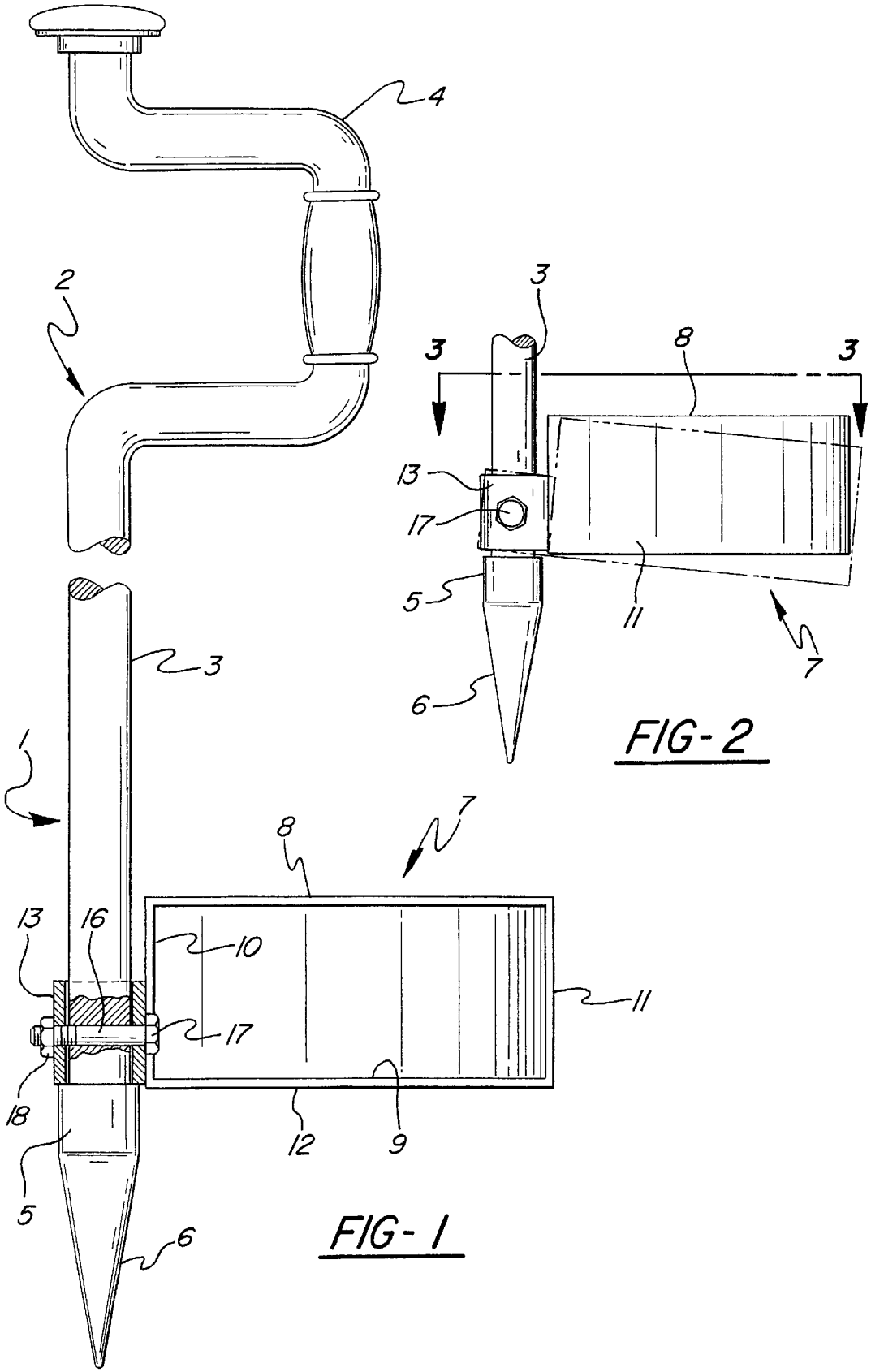
FIG. 1 is a fragmentary view partly in elevation and partly in section of one embodiment of the tool.
FIG. 2 is a fragmentary view of a portion of the apparatus shown in FIG. 1, but on a smaller scale.

The apparatus for use in removing material from the bottom of a cylindrical hole formed in the earth is designated generally by the reference character 1 and comprises a crank 2 comprising an elongate shaft 3 having adjacent one of its ends a laterally offset operating section 4. At its lower end the shaft 3 is secured to a fitting 5 which terminates in a tapered tip 6 that facilitates embedding of the lower end of the crankshaft 3 at the bottom of a hole for rotation of the crank about the longitudinal axis of the shaft 3.

A hollow housing 7 of quadrant shape, in plan, has a top wall 8, a parallel bottom wall or plate 9, and side walls 10 and 11. The wall 11 extends along an arc having its center at the axis of the crankshaft and is joined to the wall 10. The bottom wall 9 is secured to the side walls 10 and 11 and has a leading edge 12 which is beveled. The forward or leading end of the housing is open.

Figure 3:
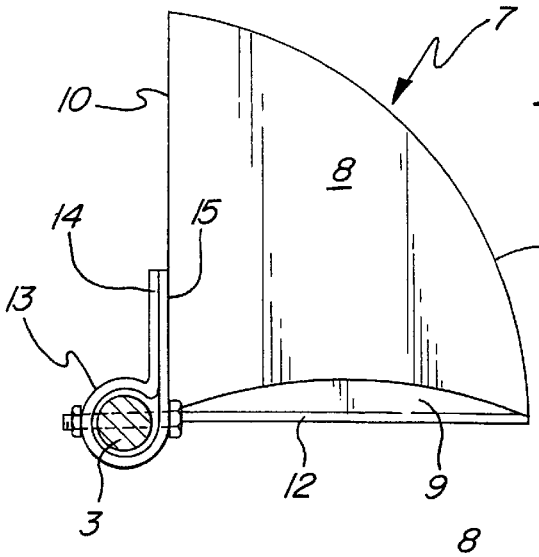
FIG. 3 is a sectional view taken on the line 3—3 of FIG. 2.

The housing 7 is coupled to the crankshaft 3 by a clasp 13 which embraces the shaft 3 and has two extensions 14 and 15 which may be welded or otherwise suitably joined together. The extension 15 also is welded or otherwise fixed to the exterior of the housing side wall 10. A bolt 16 extends through aligned openings in the clasp 13 and the shaft 3. One end of the bolt has a head 17 and the opposite end is threaded for the accommodation of a correspondingly threaded nut 18. The coupling of the housing 7 to the crank 2 is such that the housing is rockable about a substantially horizontal axis and is biased by gravity to rock from the full line position shown in FIG. 3 to the chain line position in which the inclination of the bottom 11 is downward from the open end of the housing.

In the operation of the apparatus thus far described the tapered end 6 of the crank together with the attached housing 7 may be lowered into a substantially cylindrical hole previously formed in the earth and the tapered end embedded in the earth at the bottom of the hole to form a fixed pivot point at the center of the hole bottom. Preferably, the radial dimension of the housing 7 from the longitudinal axis of the crankshaft 3 will correspond substantially to the radius of the hole with sufficient clearance between the housing side wall 11 and the side wall of the hole to enable the housing 7 to rotate freely within the hole. As the tapered end of the shaft 3 is embedded in the earth at the bottom of the hole, the housing 7 will bear upon the bottom and assume a substantially horizontal position. As the crank 2 is rotated clockwise from the position shown in FIG. 3, whatever loose material is at the bottom of the hole will be received within the housing 7. As the housing is rotated, the beveled leading edge 12 of the bottom wall 9 will enable sufficient material to be excavated to ensure the provision of a substantially horizontal bottom for the hole.

Following sufficient rotation of the crank and the housing to clear material from the bottom of the hole, the apparatus may be withdrawn upwardly from the hole. As the apparatus moves upwardly, the housing 7 will be biased by gravity to rock about the axis of the pivot bolt 16 in such direction as to cause the trailing edge of the housing and the bottom wall 9 to slope downwardly in a direction away from the open end. As a consequence, the contents of the housing will be restrained by gravity from falling out of the open end of the housing.

Figure 4:
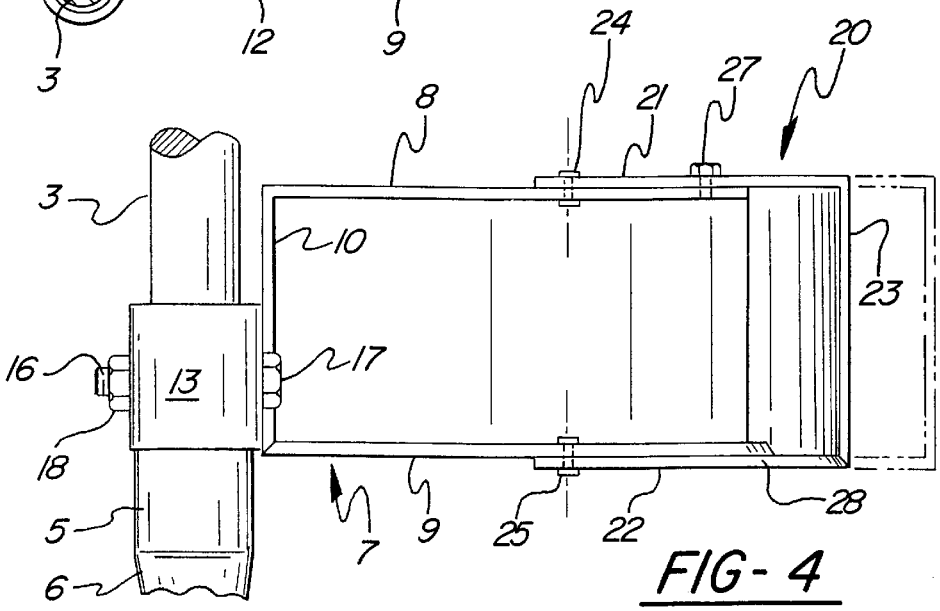
FIG. 4 is a fragmentary, elevational view of a modified embodiment.
Figure 5:
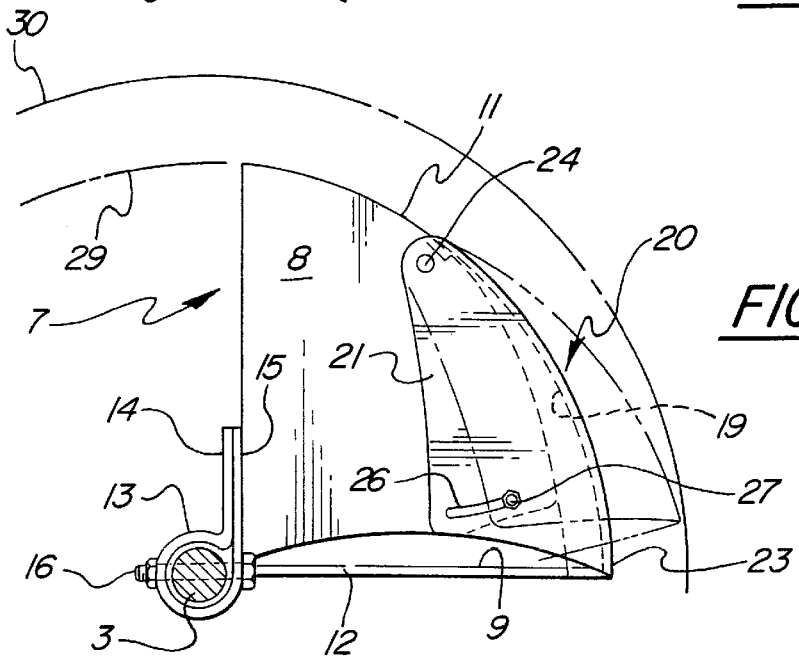
FIG. 5 is a view similar to FIG. 3, but illustrating the modification of FIG. 4.

Not all holes formed in the earth for various purposes will have the same diameter. Accordingly, it is contemplated that apparatus constructed in accordance with the invention will include housings of different radii, thereby enabling any one of a number of different size housings to be coupled to a crank. It also is possible, however, to provide a single housing having adjustable means for enabling the clearing of debris from holes of different diameters. A construction of this kind is shown in FIGS. 4 and 5 wherein the side wall 11 of the housing 7 has an opening 19 therein extending rearwardly from the leading edge 12 of the bottom wall 9 for the accommodation of a radially adjustable scoop 20 having spaced apart flanges 21 and 22 joined by a vertical wall 23. The flange 21 overlies the top wall 8 of the housing, the flange 22 underlies the bottom wall 9 of the housing, and the scoop 20 is pivoted to the housing by means of rivets 24 and 25 for rotation about a vertical axis parallel to the axis of the crankshaft 3. The flange 21 has an arcuate opening 26 therein through which extends a set screw 27 by means of which the scoop may be secured in any one of a number of retracted and projected positions relative to the axis of the crankshaft. Preferably, the leading edge of the lower flange 22 is beveled as at 28 as facilitate the entry into the housing of material from the bottom of the hole.

The modified embodiment is operable in the same manner as that described earlier, but differs from the latter in that the scoop 20 may be adjusted from the full line position shown in FIG. 5 to the chain line position and thereby increase the effective radius of the housing 7 from that indicated by the arc 29 to that indicated by the arc 30. The inclusion of the adjustable scoop 20 thus enables a single housing 7 to be adaptable for clearing material from the bottom of holes of considerably different diameters. In each instance, however, the bottom flange 22 of the scoop constitutes a continuation of the bottom plate and provides support for loose material that is introduced into the housing from its radially outer end.

This disclosure is representative of presently preferred embodiments of the invention, but is intended to be illustrative rather than definitive thereof. The invention is defined in the claims.

I claim:

1. An excavating tool for use in removing material from the bottom of a cylindrical hole formed in the earth, said tool comprising:

a. an elongate crank rotatable about a first axis and being of such length as to extend from above said hole to the bottom thereof;

b. a hollow housing open at one end and having a bottom wall and spaced apart side walls upstanding from said bottom wall; and c. means coupling said housing to said crank for conjoint movement of said crank and said housing about said first axis and for rocking movement of said housing about a second axis substantially normal to said first axis.

2. The tool according to claim 1 wherein said housing is substantially quadrant shaped in plan.

3. The tool according to claim 2 wherein said housing is formed on an arc having its center corresponding substantially to said first axis.

4. The tool according to claim 1 wherein said coupling means is adjacent the open end of said housing.

5. The tool according to claim 4 wherein the positioning of said coupling means adjacent to said open end of said housing enables gravity to bias said housing automatically to rock about said second axis in such direction as to cause the bottom wall of said housing to slope downwardly in a direction away from said open end of said housing.

6. The tool according to claim 1 wherein said crank extends beyond the bottom wall of said housing.

7. The tool according to claim 6 wherein that end of said crank which extends beyond said bottom wall of said housing terminates in a tapered tip.

8. The tool according to claim 1 wherein one of said side walls of said housing is remote from said coupling means, said one of said side walls having an opening therein extending rearwardly from the open end of said housing, and a scoop occupying said opening and being rockable about a third axis parallel to said first axis between retracted and extended positions relative to said first axis.

9. The tool according to claim 1 including a top wall joined to and spanning said side walls.

10. The tool according to claim 1 wherein said housing has a radius corresponding substantially to that of said hole, thereby enabling said housing to be rotated in said hole about said first axis.

11. An excavating tool for use in removing material from the bottom of a cylindrical hole formed in the earth, said tool comprising:

a. an elongate crank rotatable about a vertical axis and being of such length as to project upwardly from the bottom of said hole and outwardly of said hole;

b. a support plate coupled to said crank in a position to rest on the bottom of said hole and project radially outwardly from said axis a distance corresponding substantially to the radius of said hole; and c. upstanding side walls carried by said plate and projecting upwardly therefrom a distance sufficient to enable said plate to support material on its upper surface, said plate having a free leading edge extending substantially radially outwardly from said crank for scraping material from the bottom of said hole onto said plate, said plate having a trailing edge, said horizontal axis being so located with respect to said plate that its trailing edge is biased by gravity to a level lower than that of the leading edge.

12. The tool according to claim 11 wherein said plate is substantially quadrant shaped in plan.

13. The tool according to claim 11 wherein said plate is coupled to said crank for rocking movements of said plate relative to said crank about a horizontal axis.

14. The tool according to claim 11 wherein one of said side walls of said plate is arcuate and has a radius corresponding substantially to that of said hole.

15. The tool according to claim 11 wherein one of said side walls has a scoop adjacent the leading edge of said plate, and means coupling said scoop to said plate for movements radially inwardly and outwardly relative to said vertical axis.

16. The tool according to claim 15 wherein said scoop has a flange underlying said plate and forming a continuation thereof when said scoop occupies an adjusted position outwardly relative to said vertical axis.

17. The tool according to claim 11 wherein said housing has a top wall overlying said plate and joined to said side walls, one of said side walls having a scoop adjacent the leading edge of said plate, and means, coupling said scoop to said plate and to said top wall for movements radially inwardly and outwardly relative to said vertical axis.

18. The tool according to claim 17 including means for releasably securing said scoop in a selected position of adjustment relative to said vertical axis.

* * * * *